United States Patent [19]

Mclaughlin et al.

[11] 4,405,128

[45] Sep. 20, 1983

[54] MUSCULAR EXERCISE APPARATUS AND METHOD

[75] Inventors: Thomas M. Mclaughlin, Dadeville, Ala.; William D. McLeod, Columbus, Ga.; Nels H. Madsen, Auburn, Ala.; Ronald G. Peyton, Marietta, Ga.

[73] Assignee: Totem, Inc., Atlanta, Ga.

[21] Appl. No.: 215,227

[22] Filed: Dec. 11, 1980

[51] Int. Cl.[3] ..... A63B 21/06

[52] U.S. Cl. ..... 272/117; 272/134; 272/143; 128/25 R

[58] Field of Search ..... 272/117, 93, 116, 134, 272/143, 144, DIG. 4, 136, 138, 142

[56] References Cited

U.S. PATENT DOCUMENTS 3,858,873 1/1975 Jones ..... 272/117
4,226,414 10/1980 Coffard et al. ..... 272/117

FOREIGN PATENT DOCUMENTS 463045 7/1928 Fed. Rep. of Germany ..... 272/142
457018 7/1913 France ..... 272/134

*Primary Examiner*—William H. Grieb
*Assistant Examiner*—William R. Browne
*Attorney, Agent, or Firm*—Jones & Askew

[57] ABSTRACT

An exercise apparatus permitting external torque applied in resistance to an exercise to be adjustably controlled during the course of the exercise to match the external torque applied with the internal torque produced by the muscles involved in the exercise. The exercise apparatus is disclosed embodied in a sit-up apparatus in which weights can be adjustably mounted on weight arms extending in line with the subject's torso and behind the subject's torso for normal subjects, and below the torso to assist weak subjects for rehabilitative purposes.

4 Claims, 8 Drawing Figures

MUSCULAR EXERCISE APPARATUS AND METHOD

TECHNICAL FIELD

The present invention relates to exercise machines for use in developing muscles of the body, and more particularly relates to an exercise machine for use in doing an exercise wherein a body part is pivotable about a body joint, such as a sit-up.

BACKGROUND ART

Many types of apparatus are known for assisting persons in developing body muscles through exercises. For example, in well known exercise machines the amount of weight providing resistance to arm movements, leg movements and the like can be adjusted. Another type of a device uses cams to provide a nearly constant resistance to the force exerted by an exercising person.

U.S. Pat. No. 3,858,873 discloses an exercising device utilizing spiral pulleys to attempt to provide a roughly equal resistance throughout a curl exercise. U.S. Pat. No. 3,010,720 discloses an exercise rack with a sit-up board that can be sloped upwards or downwards. U.S. Pat. Nos. 3,545,748, 4,098,502 and 2,783,045 all disclose exercise boards or benches that include means for adjusting the tilt of the bench or board.

SUMMARY OF THE INVENTION

The present invention provides an exercise apparatus that matches the external torque applied in the course of an exercise to the internal torque produced by contraction of the muscles of the subject. Generally described, the invention is an exercise apparatus for exercising a body part pivotable about a joint by movement of muscles between an extended position and a flexed position, comprising a stress applying means for applying a predetermined pattern of external torque about the joint during the movement of the muscles, a body engaging means connected to the stress applying means for engaging the body part at a location spaced apart from the joint, and a means for adjusting the pattern of torque applied by the stress applying means.

When a person exercises by moving a body part about a joint, an internal torque is produced from the contractions of the muscles involved in the exercise. Biomechanical testing has resulted in the charting of patterns for the internal torque produced over the range of movement in such exercises. By matching the external torque applied in resistance to the exercise to the internal torque produced by contraction of the muscles involved, muscle strength throughout the entire range of motion in the exercise can be efficiently developed. No known prior exercise machine has the capability to adjustably match the external torque applied during an exercise to the internal torque produced by the muscles of the particular subject.

The principles of the present invention are particularly suited to be embodied in a sit-up exercise apparatus comprising a table, a weight arm pivotally mounted at one end thereof about a pivot axis adjacent to the upper surface of the table, and a chest-engaging means attached to the weight arm spaced apart from the pivot axis for engaging the chest of a person doing a sit-up. A weight or weights are preferably adjustably retained at any one of a plurality of positions along the weight arm. A second weight arm can be attached to the first weight arm extending therefrom behind the person, with the table being elevated to permit free movement of the second weight arm with the first weight arm. The apparatus can additionally include a third weight arm extending in a generally opposite direction from the first weight arm and pivotal with the first weight arm. By adjusting the position of the weights on the weight arms, the pattern of external torque applied in resisting the sit-up can be adjusted.

In the case of a weak person in need of rehabilitation, the muscles do not produce enough internal torque to enable the person to perform enough exercises to be physiologically beneficial to the muscles. The matching of the applied external torque to the weak internal torque results in assisting the weak person to do the exercise, rather than making the exercise more difficult, until the muscles become developed. The third weight arm described above receives weights for assisting weak persons in performing sit-ups.

Although the present invention is shown and described herein as embodied in a sit-up machine, the principles of the invention can be applied to machines to be used in conjunction with many other body exercises.

Thus, it is an object of the present invention to provide an improved exercise apparatus capable of matching the applied external torque to the internal torque produced by the body muscles during an exercise.

It is a further object of the invention to provide an improved sit-up machine in which adjustable weight arms are used to match the external torque applied by the machine in resistance to a sit-up to the internal torque produced by the body muscles during the entire range of movement of the sit-up.

It is a further object of the present invention to provide an exercise apparatus that can be adjusted to either provide resistance to doing an exercise or provide assistance to doing the exercise.

It is a further object of the invention to provide an exercise apparatus that can be adjusted to allow a person to select any desired pattern of external torque to be applied in resistance to an exercise.

Other objects, features and advantages of the present invention will become apparent upon reading the following specification when taken in conjunction with the drawing and the appended claims.

DETAILED DESCRIPTION

Figure 1:
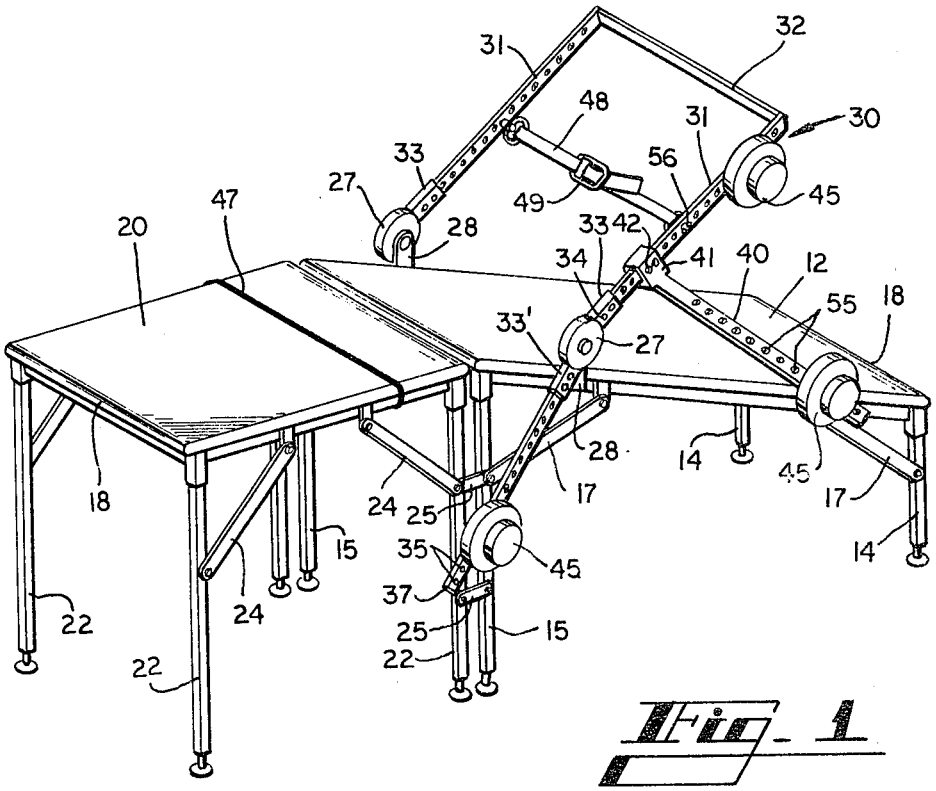
FIG. 1 is a perspective view of a sit-up machine embodying the present invention.

Referring now in more detail to the drawing, in which like numerals represent like parts throughout the several views, FIG. 1 shows a perspective view of a sit-up machine 10 embodying the principles of the present invention. The sit-up machine 10 includes an inclined table 12, preferably inclined at an angle of about 20° from the horizontal. The inclined table 12 is supported by a pair of legs 14 at one end thereof, and a pair of somewhat longer legs 15 at the opposite end thereof. A plurality of braces 17 connecting the legs 14 and 15 to the table 12 give strength and rigidity to the structure of the inclined table 12. A layer of foam 18, which can be about two inches thick, is fixed to the upper surface of the table 12.

The sit-up machine 10 also includes a horizontal table 20 supported by four legs 22 at a height equal to the uppermost extent of the inclined table 12. Braces 24 extending between the table 20 and the legs 22 give strength and rigidity to the table 20. A layer of foam 18 is also fixed to the top of the horizontal table 20. The horizontal table 20 is located immediately adjacent to the upper end of the inclined table 12, and is fixed thereto by interconnecting links 25 which join a pair of the legs 22 of the horizontal table 20 to the legs 15 of the inclined table 12.

A pair of bearings 27 are mounted to the opposite sides of the inclined table 12 by struts 28 which position the bearings above the upper surface of the table 12 to form a pivot axis adjacent to the surface of the table. The struts 28 are located a short distance down the inclined table 12 from its upper end. To the bearings 27 is attached a U-shaped frame comprising a pair of radial arms 31 which extend from the bearings 27 above the inclined table 12, and a connecting brace 32 which joins the radial arms 31 at the ends thereof opposite the bearings 27. The radial arms 31 slip into an upper pair of sockets 33 that are fixed to the bearings 27. The sockets 33 include holes 34 which mate with holes 35 in the radial arms to permit the arms 31 to be bolted in the sockets 33.

Figure 2:
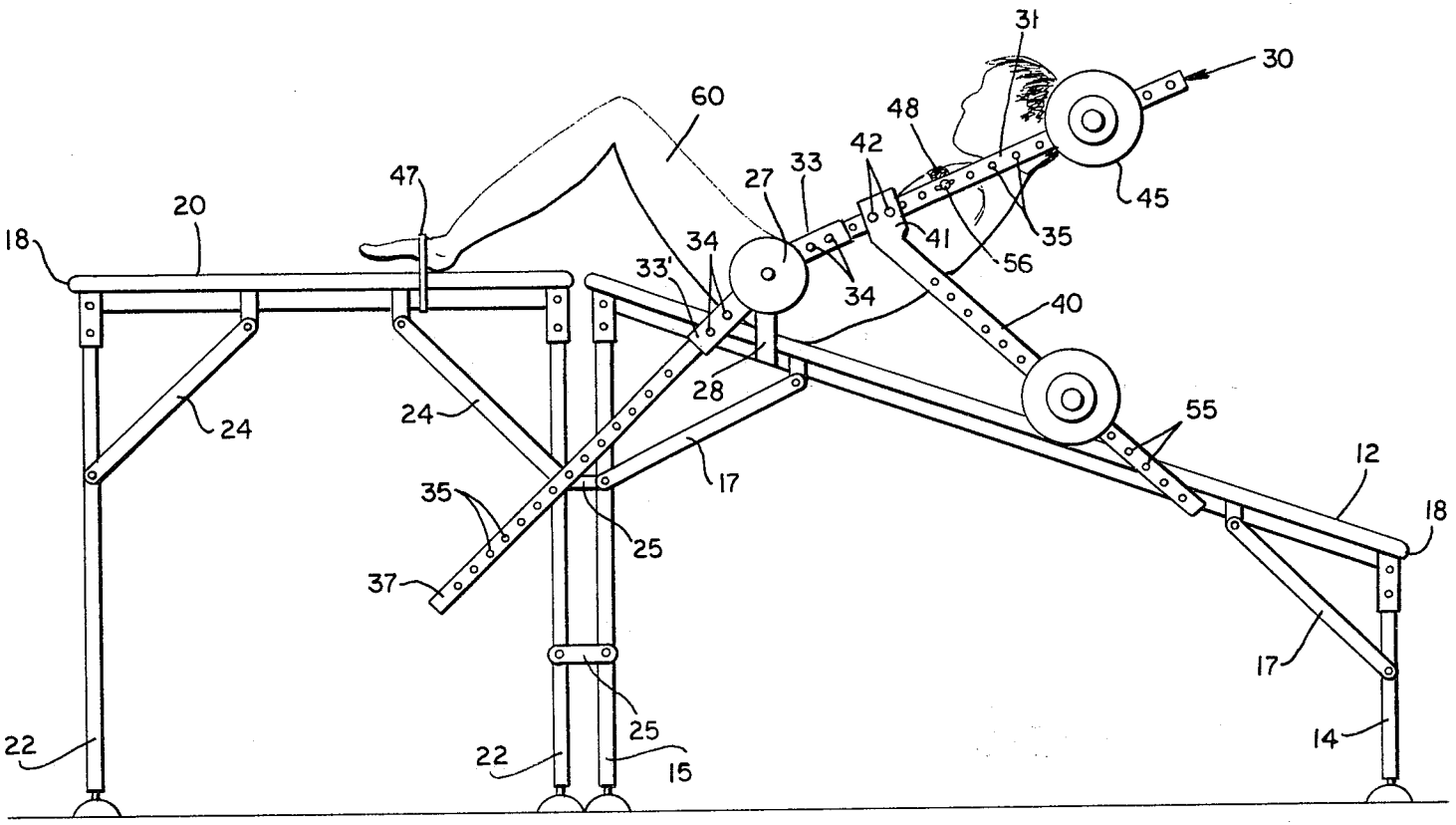
FIG. 2 is a side elevational view of the sit-up machine shown in FIG. 1.

A lower socket 33' is fixed to one of the bearings 27 at the opposite side of the bearing 27 from the upper socket 33, as shown in FIG. 2. The lower socket 33' is preferably separated from the upper socket 33 by an angle of about 160°. An assistive weight arm 37 can be inserted into the lower socket 33' and bolted in place by alignment of holes 34 in the socket and holes 35 in the weight arm 37.

A rear weight arm 40 is adjustably attached to one of the radial arms 31 by means of a collar 41 slidably received by the radial arm 31. The collar 41 includes holes 42 therein. The plurality of holes 35 in the radial arms 31 extend along the length thereof to permit the collar 41 of the rear weight arm 40 to be fixed to the radial arm 31 at any selected point along its length by inserting bolts through the holes 35 and 42.

Figure 3:
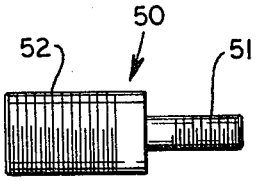
FIG. 3 is a plan view of a weight attachment pin for use with the sit-up machine embodying the present invention.

A plurality of weights 45 are provided for attachment to the arms 31, 37 and 40. Holes 35 are located along the lengths of the assistive weight arm 37 and the rear weight arm 40 as well as the radial arm 31 of the U-shaped frame 30. The holes 35 permit the weights 40 to be selectively attached to the weight arms at selected varying distances from the pivot axis defined by the bearing 27. FIG. 3 shows a weight attachment pin 50 provided for easy attachment of weights to the weight arms 31, 37 and 40. The pin 50 includes a narrow threaded portion 51 which can be inserted through a hole 35 and attached to a weight arm with a nut. A weight of weights 45 of varying size can then be slidably placed over a threaded weight-receiving portion 52 of larger diameter, and a nut can be threaded onto the pin 50 to retain the weight in place.

Figure 7:
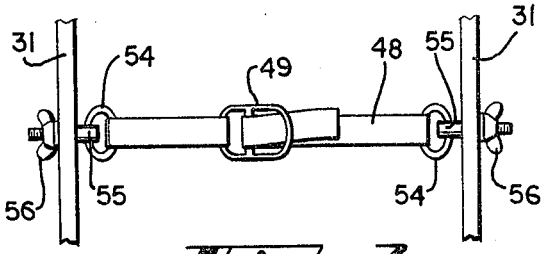
FIG. 7 is a partial view of the apparatus shown in FIG. 1, showing details of the chest harness.

A harness 48 including an adjustable buckle 49 is attached to each of the radial arms 31 to span the U-shaped frame 30 at a location between the brace 32 and the bearings 27. The harness 48 engages the chest of a person 60, as shown in FIG. 2. The harness 48, shown in more detail in FIG. 7, is constructed of an elastic material and includes a ring 54 at each end. The rings 54 are slipped over pins 55 inserted through holes 35 in the arms 31 and locked in place by wing nuts 56. It will be seen that the position of the harness can be adjusted according to the height of the person.

A footstrap 47 encircles the horizontal table 20 a short distance from the inclined table 12. Sufficient slack is provided in the footstrap 47 to receive the feet of the person 60 during the sit-up exercise. The footstrap 47 can be moved along the horizontal table according to the person's height.

In order to use the sit-up apparatus 10 embodying the present invention, weights 45 of selected weight are attached to weight arms 31 and 40, at particular selected distances from the bearing 27. If the person using the apparatus is weak and requires rehabilitation, a weight 45 can be placed on the assistive weight arm 37, also at any selected distance from the bearing 27. The chest harness 48 and footstrap 47 are then adjusted to match the height of the subject. The knees should be bent, as shown in FIG. 2, to reduce the involvement of the hip flexors in the exercise. The person then performs the sit-up by first tucking the chin against the chest and then continuing to sit up until the person is vertical. The person should be positioned so that the center of the hip joint is at the pivot axis of the bearings 27.

Figure 4:
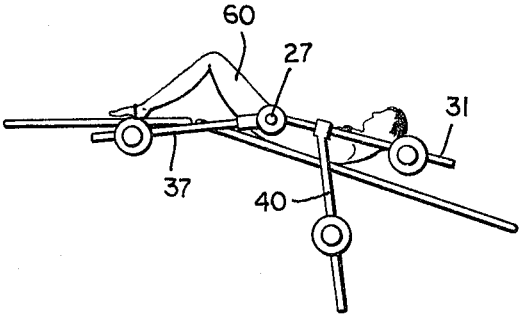
FIGS. 4–6 are diagrammatic views of three positions of the weight arms of a sit-up machine embodying the present invention during the course of a sit-up exercise.
Figure 5:
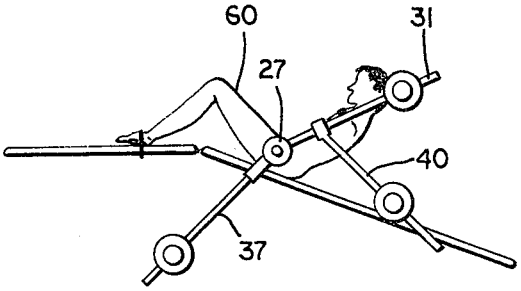

It will be seen that a sit-up machine constructed according to the present invention is uniquely variable to adjust the torque that will be applied externally in resisting the exercise at any point during the exercise. Referring to FIG. 4, a person is shown diagrammatically in a reclining position ready to begin a sit-up exercise on a sit-up machine according to the present invention. The muscle primarily involved in the sit-up, the *rectus abdominis,* is fully extended. At the position shown in FIG. 4, the weight on the radial arm 31 provides external torque resisting the upward movement of the person's torso. The weight on rear weight arm 40 is near vertical alignment with the pivot axis and therefore contributes relatively little torque. If the person is of normal or above average strength, no weight would be placed on the assistive weight arm 37. As the person raises about the hip joint as shown in FIG. 5, the external torque is maintained because of the contribution of both the weight arms 31 and 40, since the weights 45 thereon are both a significant distance from vertical alignment with the pivot axis. This contrasts with the known method of placing weights on the person's chest, wherein the external torque drops dramatically as the person's torso moves closer to vertical alignment with the pivot axis of the hip joint.

Figure 6:
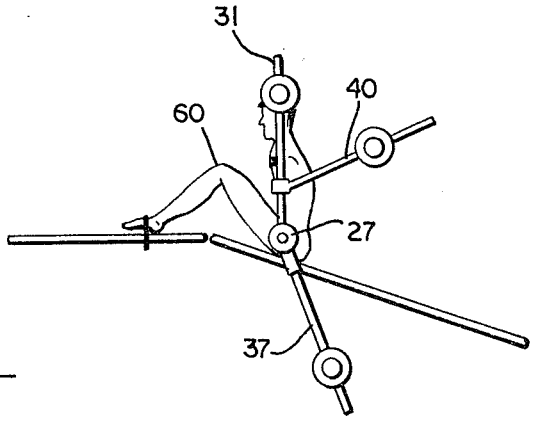

When the person reaches vertical alignment as shown in FIG. 6, the abdominal muscle is flexed. In the performance of a sit-up without an exercise apparatus, or with weights placed on the chest, there is no external torque about the hip joint at the vertical position because the weight is vertically aligned with the pivot axis. However, it will be noted that the weight on the rear weight arm 40 of the apparatus embodying the present invention extends behind the person to provide external torque to stimulate the muscles even when the person is vertical and the muscles are flexed. Thus, by controlling the external torque applied during the exercise, the apparatus 10 develops the muscles throughout the contraction of the muscles from the extended to the flexed position.

Figure 8:
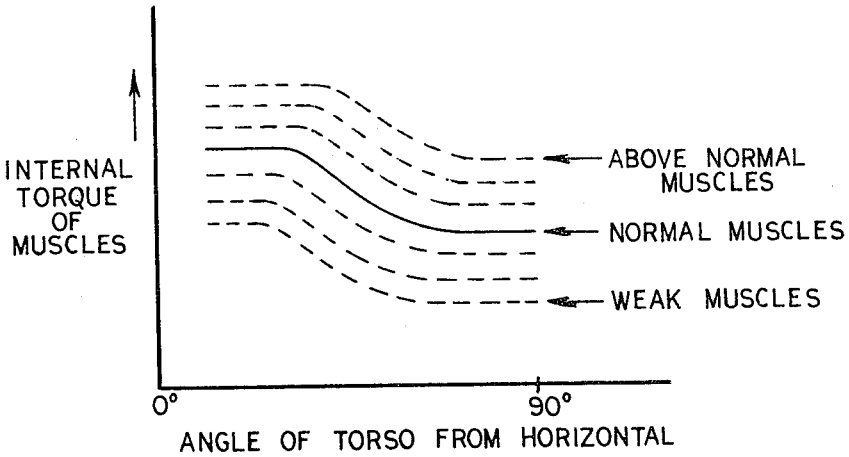
FIG. 8 is a graphic representation of typical patterns of internal torque produced by muscles involved in a sit-up exercise.

The weights are preferably placed on the weight arms to apply a pattern of external torque approximately matching the pattern of internal torque produced by the involved muscles of the particular person. FIG. 8 graphically shows several possible patterns of internal torque for persons whose muscles range from above normal to below normal strength. The pattern of internal torque produced by a particular person's muscles can be actually measured or can be approximated based on the person's overall fitness or ability to do the exercise.

The actual pattern of internal torque produced by a particular person's muscles during an exercise can be measured by determining the maximum weight that the person can support at a sequence of positions throughout the exercise. The values obtained can be converted to torque by multiplying each value by the distance between the weight and a vertical line through the pivoting body joint. The values of torque can be plotted against position to give the pattern of maximum torque that can be generated by the involved muscles at each position throughout the exercise. In addition, the activity of the most important muscles to be developed can be monitored by electromyography in a manner known to those skilled in the art. It is then possible to insure that the pattern of involvement of such muscles are monitored follows the measured pattern of internal torque.

Following a determination of the pattern of internal torque, weights can then be placed on the weight arms so that at any point during the exercise the external torque approximately equals the internal torque. For normal subjects, it has been found advantageous to put weights at a ratio of 4:1 on weight arms 31 and 40, respectively, and to separate such weights from the pivot axis by distances having a ratio of about 3:2 for the weight arms 31 and 40, respectively. For example, a weight of forty pounds could be placed three feet from the pivot axis on weight arm 31, and a weight of ten pounds could be placed two feet from the pivot axis on the weight arm 40.

In the case of weak subjects requiring rehabilitation, weights are placed on all three weight arm 31, 37 and 40, with considerable weight on the assistive weight arm 37. The weights are adjusted so that the person can comfortably perform a beneficial number of sit-ups. In this case, the harness 48 is placed behind the back of the person so that the weights 45 on the weight arm 37 actually assist in raising the person's torso. Alternately, a harness can be provided on both sides of the person's torso so that the person is assisted by the weight arm 37 in the initial portion of the sit-up when the abdominal muscles are extended, but is resisted by the rear weight arm 40 when the subject becomes upright and the muscles are flexed.

It will thus be seen that the adjustment means of a sit-up machine according to the present invention allows a single exercise apparatus to be adjusted from a configuration in which resistance is provided to doing the exercise, to a configuration in which the person is assisted in performing the exercise. Furthermore, the externally applied torque can be controlled at individual points during the exercise in response to the efficiency of the involved muscles and the subject's personal requirements. Such externally applied torque can be provided according to the internal torque generated by contraction of the muscles.

It will be apparent to those skilled in the art that the principle of controlled torque as disclosed herein for a sit-up apparatus 10 can be utilized in machines constructed for use with other exercises wherein body parts are pivoted about body joints. Thus, the present invention is not intended to be limited to a sit-up exercise apparatus, although its principles find particularly advantageous application when utilized in connection with a sit-up exercise.

While this invention has been described in detail with particular reference to a preferred embodiment thereof, it will be understood that variations and modifications can be effected within the spirit and scope of the invention as described hereinbefore and as defined in the appended claims.

What is claimed is:

1. A sit-up exercise apparatus comprising:

a table;

a first elongated weight arm pivotally mounted at one end thereof about a pivot axis adjacent to the upper surface of said table said arm supporting a weight being spaced there-along from said pivot axis;

chest-engaging means attached to said first weight arm spaced apart from said pivot axis for engaging the chest of a person so as to raise and lower the first arm while performing a sit-up exercise while being positioned on the table;

a second elongated weight arm having a weight attached thereto and extending at an angle from said first weight arm so as to extend behind the axis extending from the shoulder to the hip of a user, said table being elevated to permit free movement of said second weight arm with said first weight arm; and means for adjustably retaining said second weight arm at any one of a plurality of positions along said first weight arm.

2. The apparatus of claim 1 further comprising means for adjustably retaining weights as any one of a plurality of positions along said first and second weight arms.

3. The apparatus of claims 1 or 2 further comprising a third weight arm pivotally mounted at one end thereof about said pivot axis, said third weight arm extending in a generally opposite direction from said first weight arm and being fixed to said first weight arm for rotation therewith about said pivot axis.

4. The apparatus of claim 3 further comprising means for adjustably retaining a weight at any of a plurality of positions along said third weight arm.

* * * * *